US007448900B1

(12) United States Patent
Chen

(10) Patent No.: US 7,448,900 B1
(45) Date of Patent: Nov. 11, 2008

(54) WIRES CONNECTION DEVICE

(75) Inventor: Joe Chen, Ta Li (TW)

(73) Assignee: Ata Auto Industries Co., Ltd., Taichung, Hsien (TW)

( * ) Notice: Subject to any disclaimer, the term of this patent is extended or adjusted under 35 U.S.C. 154(b) by 0 days.

(21) Appl. No.: 11/905,781

(22) Filed: Oct. 4, 2007

(51) Int. Cl.
*H01R 4/24* (2006.01)

(52) U.S. Cl. ..... 439/409; 439/402; 439/413

(58) Field of Classification Search ..... 439/402, 439/409, 417, 413
See application file for complete search history.

(56) References Cited

U.S. PATENT DOCUMENTS 3,118,715 A * 1/1964 Potruch ..... 439/400
4,047,784 A * 9/1977 Trank ..... 439/403
6,299,472 B1 * 10/2001 Beukes ..... 439/403

* cited by examiner

*Primary Examiner*—Tho D Ta
(74) *Attorney, Agent, or Firm*—Troxell Law Ofice, PLLC

(57) ABSTRACT

A wires connection device includes a body having a chamber defined in a top thereof and a sidewall of the chamber includes a through hole through which a sub-wire extends. A groove is defined in the top of the body and communicates with the through hole via a recess in another sidewall of the chamber. A main wire is engaged with the groove. A slot is defined in an inner periphery of the recess and extends to the groove. A positioning member is received in the chamber and has a conductive member which is engaged with the slot. The conductive member includes a first conductive section to penetrate the sheath of the sub-wire and a second conductive section which penetrate the sheath of the main wire. A cover is mounted to the top of the body and presses the positioning member.

18 Claims, 7 Drawing Sheets

WIRES CONNECTION DEVICE

FIELD OF THE INVENTION

The present invention relates to a wires connection device which connects multiple wires and the wires are positioned firmly by the connection member.

BACKGROUND OF THE INVENTION

A conventional wires connection is shown in FIG. 7 and generally includes a main wire 92 and multiple sub-wires 91 are connected to the main wire 92 at different positions so as to power multiple ceiling lights as shown. The conventional way to connect the main wire 92 and the sub-wires 91 are to remove a part of the sheath from the main wire 92 and the sub-wires 91 are then connected to the exposed parts of the core of the main wire 92. However, the connection requires a lot of time to remove the sheath and to tie the sub-wires to the core of the main wire 92.

The present invention intends to provide a wires connection device which includes a body with a cover, and a positioning member with a conductive member are received in the body. The main wire and the sub-wire are electrically connected to each other by the conductive member which includes penetration portions to penetrate the sheath and contact the cores in the main wire and the sub-wires.

SUMMARY OF THE INVENTION

The present invention relates to a wires connection device which comprises a body with a chamber defined in a top thereof and a sidewall of the chamber includes a through hole. A groove is defined in the top of the body and communicates with the through hole via a recess in another sidewall of the chamber. A slot is defined in an inner periphery of the recess and extends to the groove. A positioning member is received in the chamber and has a conductive member which is engaged with the slot. The conductive member includes a first conductive section defined in an underside thereof and a second conductive section is defined in a top of the conductive member. The second conductive section is located in the groove. A cover is mounted to the top of the body and presses the positioning member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
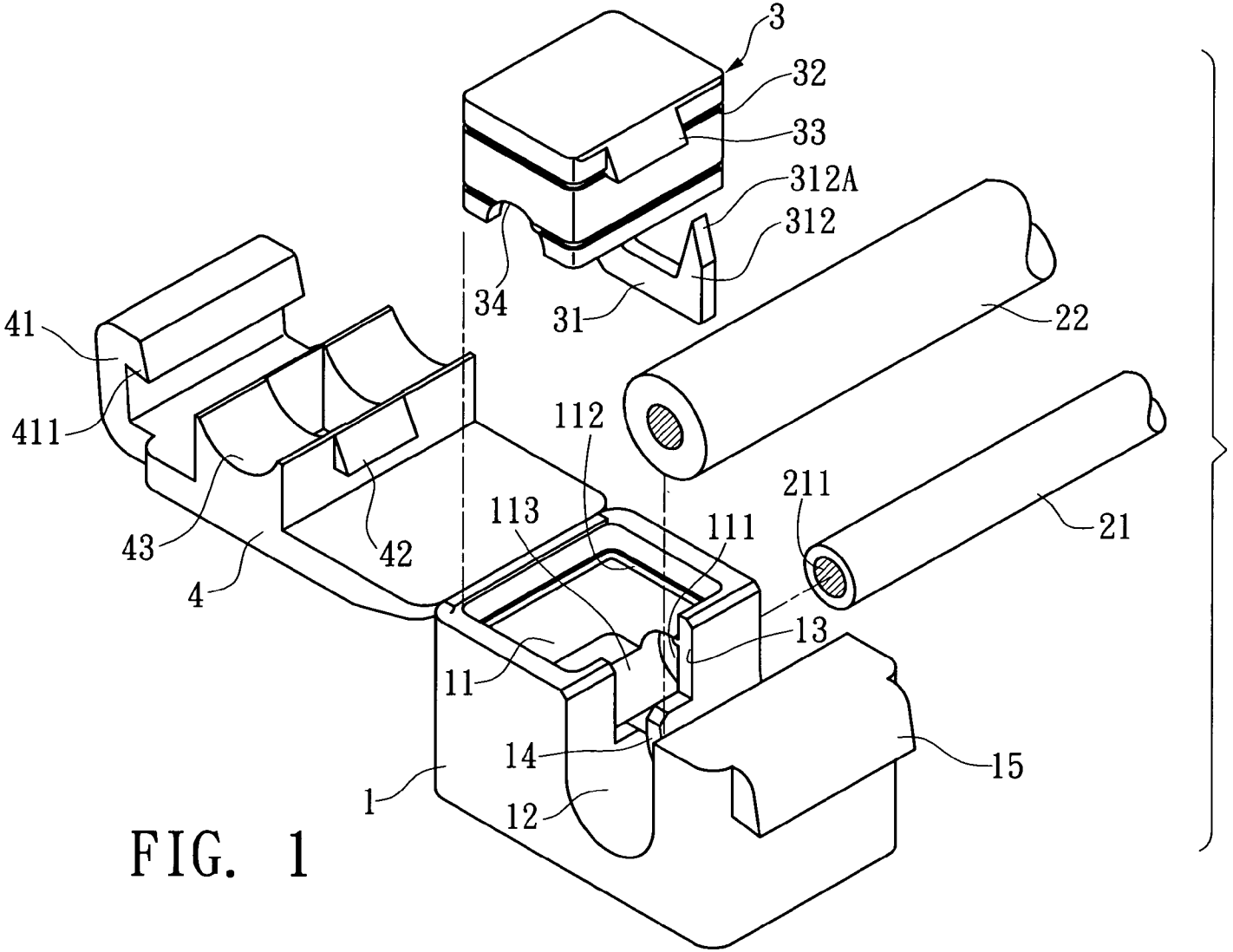
FIG. 1 is an exploded view to show the wires connection device of the present invention.
Figure 2:
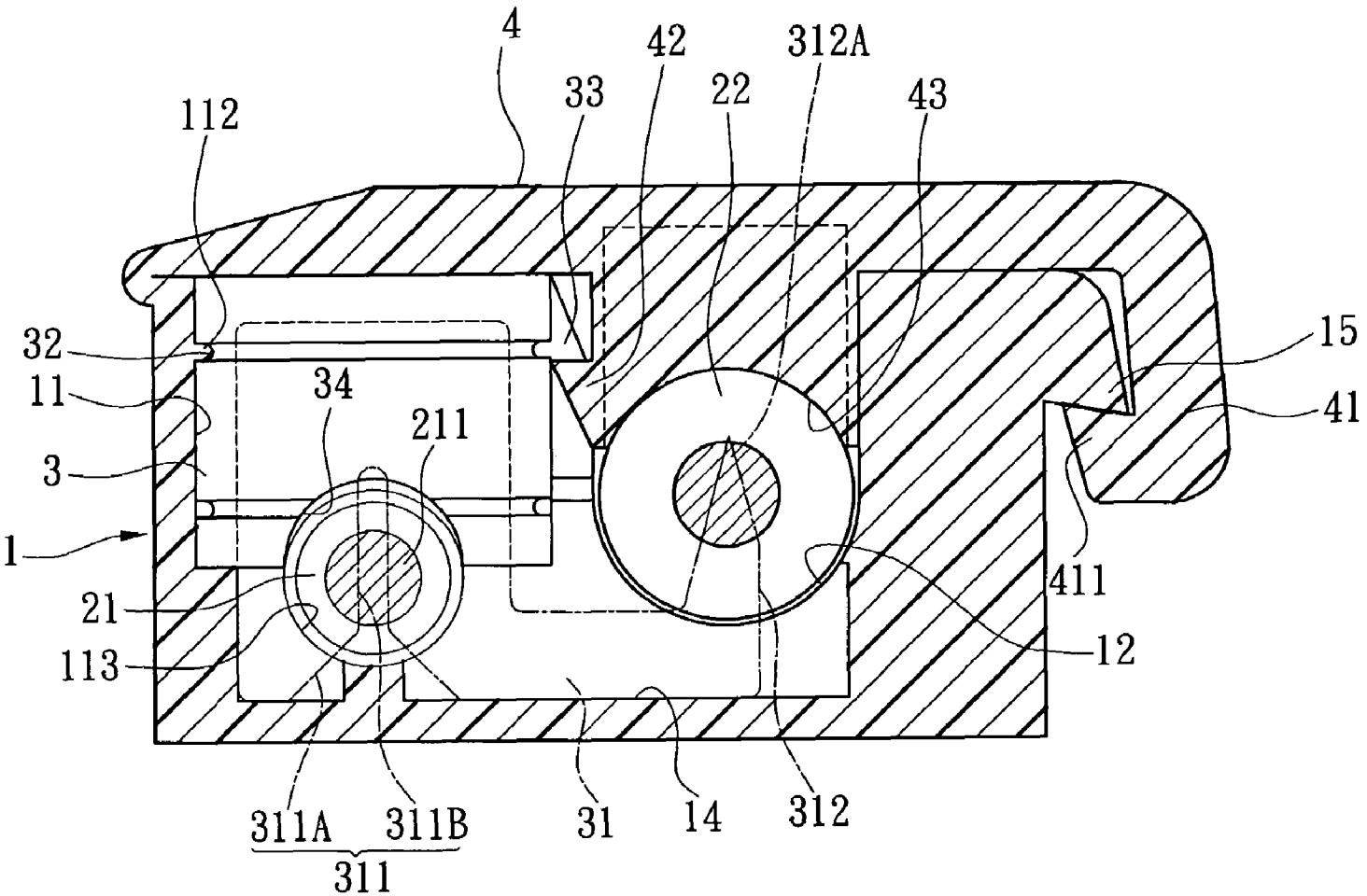
FIG. 2 is a cross sectional view to show the wires connection device of the present invention.

Referring to FIGS. 1 and 2, the wires connection device of the present invention comprises a body 1 having a chamber 11 defined in a top thereof and a sidewall of the chamber 11 includes a through hole 111. A concaved space 113 is defined in an inner end of the chamber 11 and communicates with the through hole 111. A groove 12 is defined in the top of the body 1 and communicates with the through hole 111 via a recess 13 defined in another sidewall of the chamber 11. A slot 14 is defined in an inner periphery of the recess 13 and extends to the groove 12.

A positioning member 3 is received in the chamber 11 and has a conductive member 31 which extends from an underside thereof and is engaged with the slot 14. At least one ridge 112 extends from an inside of the chamber 11 and the positioning member 3 includes at least one engaging groove 32 defined in an outside thereof, the at least one ridge 112 is engaged with the at least one engaging groove 32. The conductive member 31 includes a first conductive section 311 defined in an underside thereof and a second conductive section 312 defined in a top of the conductive member 31. The second conductive section 312 is located in the groove 12.

A main wire 22 is engaged with the groove 12 and a sub-wire 21 extends into the chamber 11 via the through hole 111 and is received in the concaved space 113. The first conductive section 311 of the conductive member 31 penetrates a sheath of the sub-wire 21 and contacts a core 211 in the sub-wire 21, and the second conductive section 312 of the conductive member 31 penetrates a sheath of the main wire 22 and contacts a core in the main wire 22 so as to electrically connect the main wire 22 and the sub-wire 21. The first conductive section 311 includes a tapered first guide notch 311A and a first slit 311B is defined in an inner periphery of the first guide notch 311A. The tapered first guide notch 311A includes a wide opening which easily positions the sub-wire 21 and the inner periphery of the first guide notch 311A and the first slit 311B cut the sheath of the sub-wire 21 to contact the core 211 of the sub-wire 21. The second conductive section 312 of the conductive member 31 includes a tip 312A which penetrates through the sheath of the main wire 22 so as to contact the core in the main wire 22.

A cover 4 has a first end pivotably connected to a first end of the body 1 and a first engaging member 41 is connected to a second end of the cover 4. The first engaging member 41 includes a hook portion 411. The body 1 includes a second engaging member 15 connected to a second end thereof so that the hook portion 411 of the first engaging member 41 is hooked to the second engaging member 15 when the cover 4 is mounted to the top of the body 1. The underside of the cover 4 presses the positioning member 3.

The positioning member 3 includes a first protrusion 33 extending from a side thereof and the protrusion 33 is located corresponding to the recess 13 of the body 1. The cover 4 includes a second protrusion 42 which is engaged with the first protrusion 33 when the cover 4 is covered on the body 1 to further position the positioning member 3. The positioning member 3 includes a concaved surface 34 defined in the underside thereof and the concaved surface 34 of the positioning member 3 presses the sub-wire 21 in the concaved space 113. The cover 4 further includes a concaved curved surface 43 defined in the underside thereof and the main wire 22 is pressed by the concaved curved surface 42.

Figure 3:
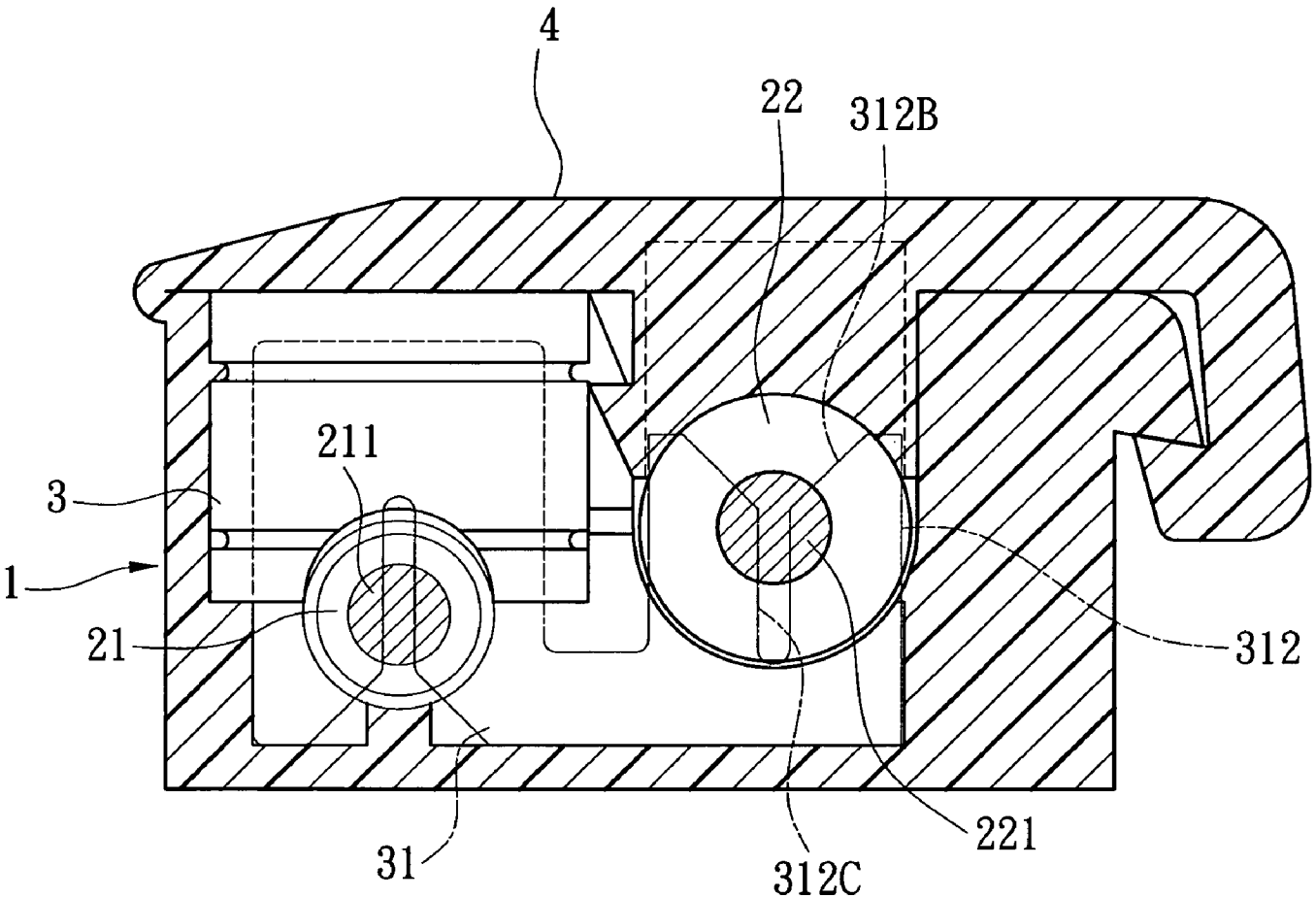
FIG. 3 is a cross sectional view to show the wires connection device of the present invention, wherein a second embodiment of the second conductive section is shown.

As shown in FIG. 3 which shows another embodiment of the second conductive section 312 of the conductive member 31, wherein the second conductive section 312 includes a tapered second guide notch 312B and a second slit 312C is defined in an inner periphery of the second guide notch 312B. The inner periphery of the second guide notch 312B and the second slit 312C cut the sheath of the main wire 22 to contact the core of the main wire 22.

Figure 4:
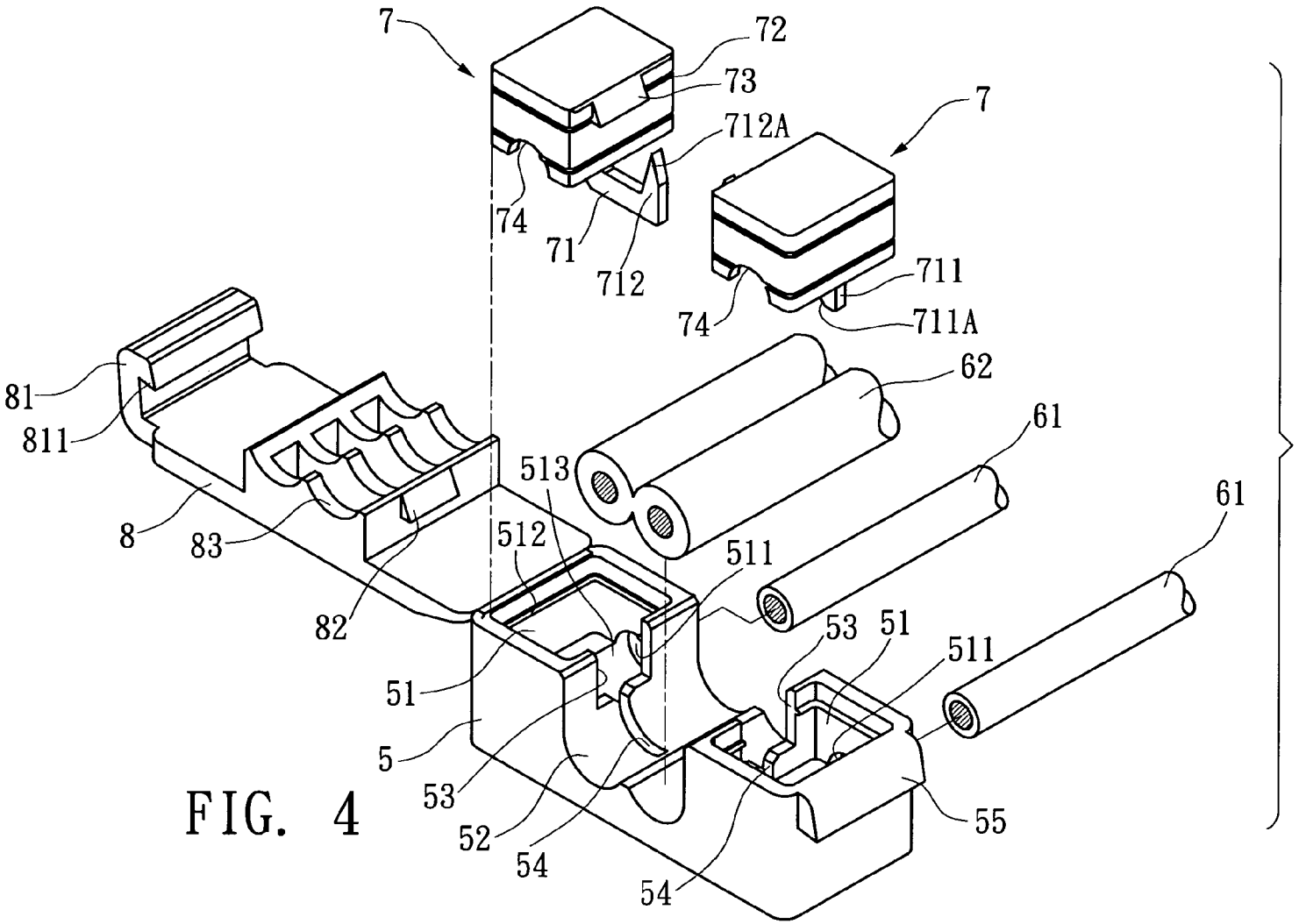
FIG. 4 is an exploded view to show another embodiment of the wires connection device of the present invention.
Figure 5:
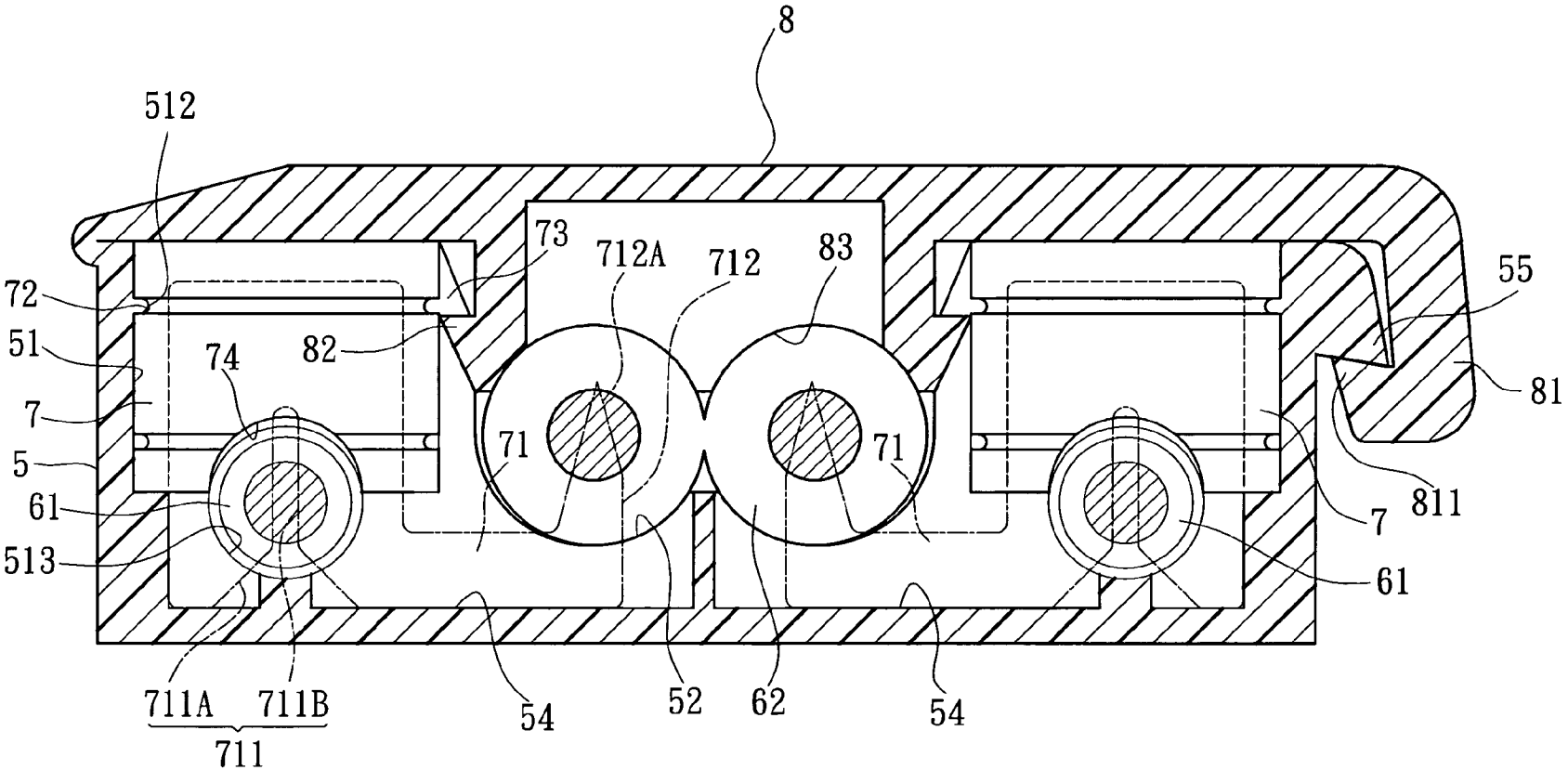
FIG. 5 is a cross sectional view to show the wires connection device of the present invention.

FIGS. 4 and 5 show another embodiment of the wires connection device which comprises a body 5 having two separated chambers 51 defined in a top thereof and a sidewall of each of the chambers 11 includes a through hole 511. A concaved space 513 is defined in an inner end of each of the chambers 51 and communicates with the through hole 511 corresponding thereto. A groove 52 is defined in the top of the body 5 and located between the two chambers 51, the groove 52 communicating with the two respective through holes 511 via the two respective recesses 53 in two other respective sidewalls of the two chambers 51. Two slots 54 are defined in two respective inner peripheries of the two recesses 53 and extend to the groove 52 respectively.

Two positioning members 7 are respectively received in the two chambers 51 and each have a conductive member 71 which is engaged with the slot 54 corresponding thereto. At least one ridge 512 extends from an inside of each of the chambers 51 and each of the positioning members 7 includes at least one engaging groove 72 defined in an outside thereof. The at least one ridge 512 is engaged with the at least one engaging groove 72. Each of the conductive members 71 includes a first conductive section 711 defined in an underside thereof and a second conductive section 712 defined in a top of each of the conductive members 71. The two respective second conductive sections 712 are located in the groove 52.

A main wire 62 is engaged with the groove 52 and two sub-wires 61 extend into the two chambers 51 via the two through holes 511. The first conductive section 711 of each of the conductive members 71 penetrates the sheath of the sub-wire 61 and contacts a core in the sub-wire 61. The second conductive section 712 of each of the conductive members 71 penetrates a sheath of the main wire 62 and contacts a core in the main wire 62 so that the main wire 62 is electrically connected to the two sub-wires 61 by the conductive members 71. Each of the first conductive sections 711 includes a tapered first guide notch 711A and a first slit 711B is defined in an inner periphery of the first guide notch 711A. The periphery of the first guide notch 711A and the first slit 711B cut the sheath and contacts the core of the sub-wire 61. Each of the second conductive sections 712 of the conductive member 71 includes a tip 712A which penetrates the sheath of the main wire 62 and contacts the core of the main wire 62. Each of the positioning member 7 includes a concaved surface 74 defined in the underside thereof and the two respective concaved surfaces 74 of the positioning members 7 press the sub-wires 61 in the concaved spaces 513.

A cover 8 has a first end pivotably connected to a first end of the body 5 and a first engaging member 81 is connected to a second end of the cover 5, the first engaging member 81 includes a hook portion 811. The body 5 includes a second engaging member 55 connected to a second end thereof and the hook portion 811 of the first engaging member 81 is hooked to the second engaging member 55. Each of the positioning members 7 includes a first protrusion 73 extending from a side thereof and the protrusion 73 is located corresponding to the recess 53 corresponding thereto. The cover 8 includes two second protrusions 82 which are engaged with the two respective first protrusions 73 when the cover 8 is covered on the body 5. The cover 8 further includes two concaved curved surfaces 83 defined in the underside thereof and the main wires 62 are pressed by the concaved curved surfaces 82.

Figure 6:
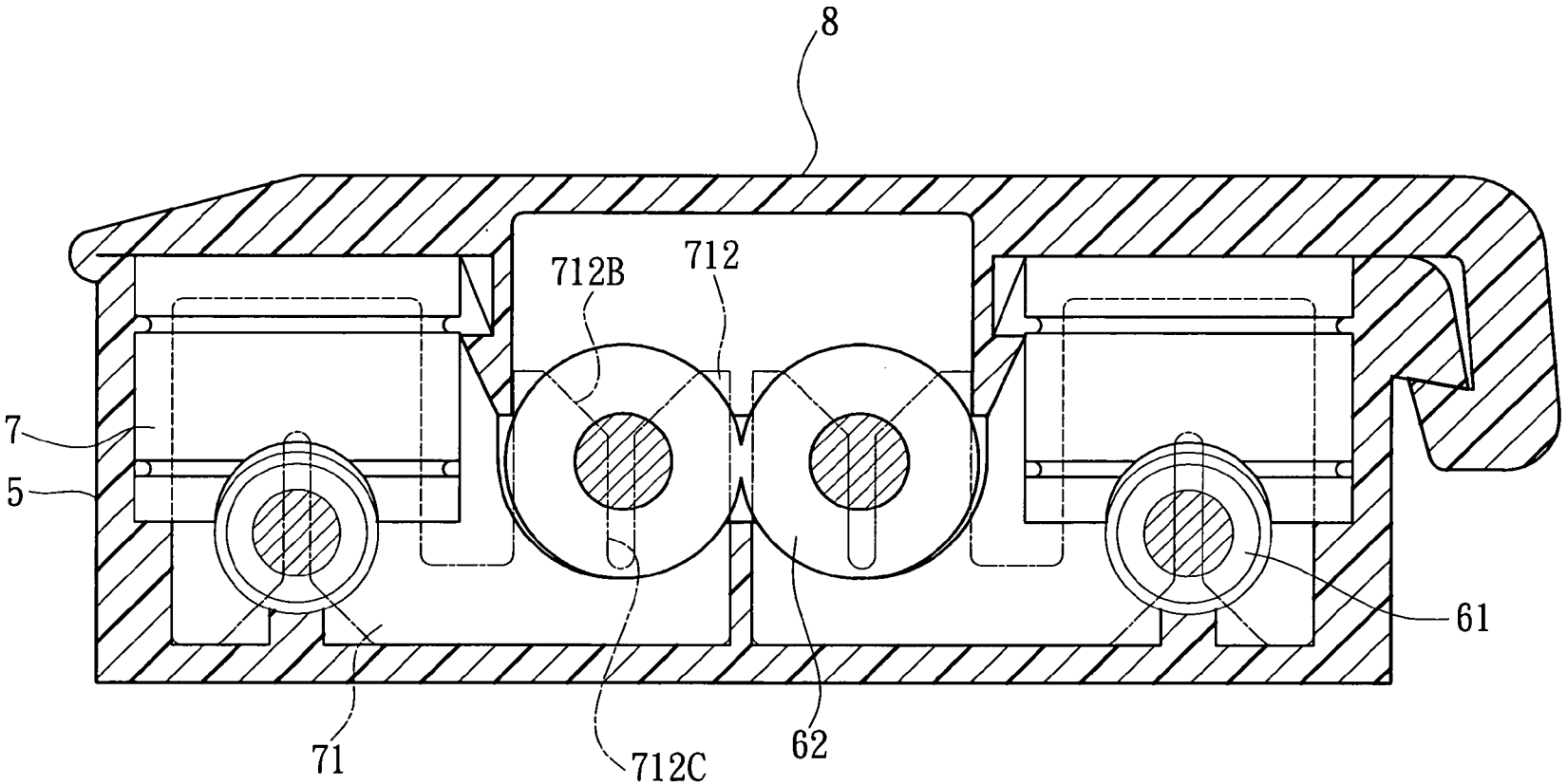
FIG. 6 is a cross sectional view to show the wires connection device of the present invention, wherein a second embodiment of the second conductive section is shown.
Figure 7:
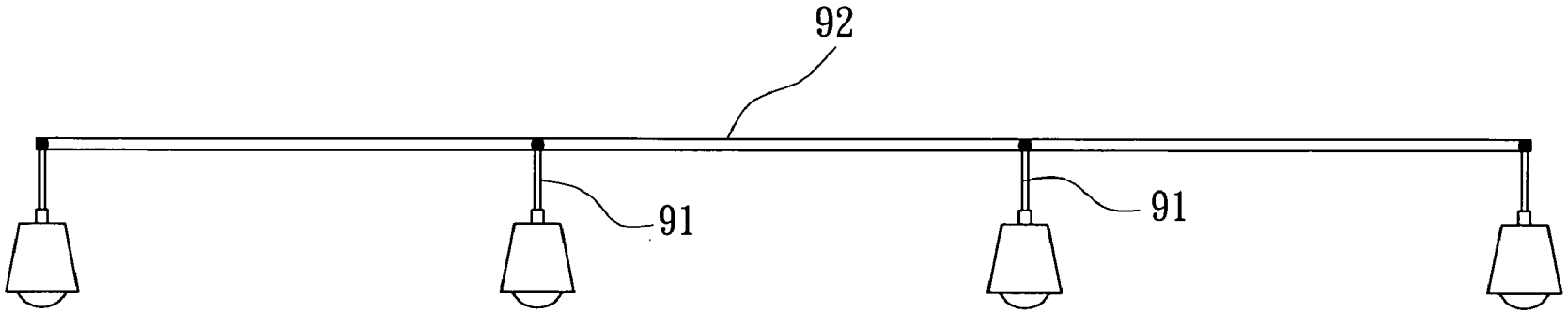
FIG. 7 PRIOR ART
FIG. 7 shows conventional connection of a main wire with multiple sub-wires.

FIG. 6 shows another embodiment of the second conductive section 712 of each of the conductive members 71, wherein each of the second conductive sections 712 of the conductive member 71 includes a tapered second guide notch 712B and a second slit 712C is defined in an inner periphery of the second guide notch 712B. The inner periphery of the second guide notch 712B and the second slit 712C cut the sheath of the main wire 62 to contact the core of the main wire 62.

The device allows the user to quickly connect the main wire 22/62 with the sub-wires 21/61 without peeling the sheaths of the wires.

While we have shown and described the embodiment in accordance with the present invention, it should be clear to those skilled in the art that further embodiments may be made without departing from the scope of the present invention.

What is claimed is:

1. A wires connection device comprising:

a body having a chamber defined in a top thereof and a sidewall of the chamber including a through hole, a groove defined in the top of the body and communicating with the through hole via a recess in another sidewall of the chamber, a slot defined in an inner periphery of the recess and extending to the groove;

a positioning member received in the chamber and having a conductive member which is engaged with the slot, the conductive member including a first conductive section defined in an underside thereof and a second conductive section defined in a top of the conductive member, the second conductive section located in the groove, and a cover mounted to the top of the body and pressing the positioning member, wherein a main wire is engaged with the groove and a sub-wire extends into the chamber via the through hole, the first conductive section of the conductive member penetrates a sheath of the sub-wire and contacts a core in the sub-wire, the second conductive section of the conductive member penetrates a sheath of the main wire and contacts a core in the main wire, the cover presses the main wire, wherein the cover includes a concaved curved surface defined in an underside thereof and the main wire is pressed by the concaved curved surface.

2. The device as claimed in claim 1, wherein the first conductive section includes a tapered first guide notch and a first slit is defined in an inner periphery of the first guide notch.

3. The device as claimed in claim 1, wherein the second conductive section of the conductive member includes a tip.

4. The device as claimed in claim 1, wherein the second conductive section of the conductive member includes a tapered second guide notch and a second slit is defined in an inner periphery of the second guide notch.

5. The device as claimed in claim 1, wherein the positioning member includes a first protrusion extending from a side thereof and the protrusion is located corresponding to the recess of the body, the cover includes a second protrusion which is engaged with the first protrusion when the cover is covered on the body.

6. The device as claimed in claim 1, wherein the cover has a first end pivotably connected to a first end of the body and a first engaging member is connected to a second end of the cover, the first engaging member includes a hook portion, the body includes a second engaging member connected to a second end thereof, the hook portion of the first engaging member is hooked to the second engaging member.

7. A wires connection device comprising:

a body having a chamber defined in a top thereof and a sidewall of the chamber including a through hole, a groove defined in the top of the body and communicating with the through hole via a recess in another sidewall of the chamber, a slot defined in an inner periphery of the recess and extending to the groove;

a positioning member received in the chamber and having a conductive member which is engaged with the slot, the conductive member including a first conductive section defined in an underside thereof and a second conductive section defined in a top of the conductive member, the second conductive section located in the groove, and a cover mounted to the top of the body and pressing the positioning member, wherein a main wire is engaged with the groove and a sub-wire extends into the chamber via the through hole, the first conductive section of the conductive member penetrates a sheath of the sub-wire and contacts a core in the sub-wire, the second conductive section of the conductive member penetrates a sheath of the main wire and contacts a core in the main wire, the cover presses the main wire, wherein a concaved space is defined in an inner end of the chamber and communicates with the through hole, the sub-wire is engaged with the concaved space, the positioning member includes a concaved surface defined in an underside thereof and the concaved surface of the positioning member presses the sub-wire in the concaved space.

8. The device as claimed in claim 7, wherein at least one ridge extends from an inside of the chamber and the positioning member includes at least one engaging groove defined in an outside thereof, the at least one ridge is engaged with the at least one engaging groove.

9. A wires connection device comprising:

a body having two separated chambers defined in a top thereof and a sidewall of each of the chambers including a through hole, a groove defined in the top of the body and located between the two chambers, the groove communicating with the two respective through holes via the two respective recesses in two other respective sidewalls of the two chambers, two slots defined in two respective inner peripheries of the two recesses and extending to the groove;

two positioning members respectively received in the two chambers and each having a conductive member which is engaged with the slot corresponding thereto, each of the conductive members including a first conductive section defined in an underside thereof and a second conductive section defined in a top of each of the conductive members, the two respective second conductive sections located in the groove, and a cover mounted to the top of the body and pressing the two positioning members.

10. The device as claimed in claim 9, wherein a main wire is engaged with the groove and two sub-wires extend into the two chambers via the two through holes, the first conductive section of each of the conductive members penetrates a sheath of the sub-wire and contacts a core in the sub-wire, the second conductive section of each of the conductive members penetrates a sheath of the main wire and contacts a core in the main wire, the cover presses the main wire.

11. The device as claimed in claim 10, wherein each of the first conductive sections includes a tapered first guide notch and a first slit is defined in an inner periphery of the first guide notch.

12. The device as claimed in claim 10, wherein each of the second conductive sections of the conductive member includes a tip.

13. The device as claimed in claim 10, wherein each of the second conductive sections of the conductive member includes a tapered second guide notch and a second slit is defined in an inner periphery of the second guide notch.

14. The device as claimed in claim 10, wherein each of the positioning members includes a first protrusion extending from a side thereof and the protrusion is located corresponding to the recess corresponding thereto, the cover includes two second protrusions which are engaged with the two respective first protrusions when the cover is covered on the body.

15. The device as claimed in claim 10, wherein the cover includes two concaved curved surfaces defined in an underside thereof and the main wires are pressed by the concaved curved surfaces.

16. The device as claimed in claim 10, wherein the cover has a first end pivotably connected to a first end of the body and a first engaging member is connected to a second end of the cover, the first engaging member includes a hook portion, the body includes a second engaging member connected to a second end thereof, the hook portion of the first engaging member is hooked to the second engaging member.

17. The device as claimed in claim 10, wherein a concaved space is defined in an inner end of each of the chambers and communicates with the through hole corresponding thereto, the sub-wires are engaged with the two respective concaved spaces, each of the positioning member includes a concaved surface defined in an underside thereof and the two respective concaved surfaces of the positioning members press the sub-wires in the concaved spaces.

18. The device as claimed in claim 10, wherein at least one ridge extends from an inside of each of the chambers and each of the positioning members includes at least one engaging groove defined in an outside thereof, the at least one ridge is engaged with the at least one engaging groove.

* * * * *